US006062259A

United States Patent [19]

Poirier

[11] Patent Number: 6,062,259

[45] Date of Patent: May 16, 2000

[54] METHOD AND APPARATUS FOR PREVENTING WATER FROM STAGNATING IN BRANCHES OF A MUNICIPAL WATER SUPPLY SYSTEM

[76] Inventor: Blair J. Poirier, P. O. Box 251 Chemin Leandre Poirier Shediac Bridge, New Brunswick, Canada, EOA 3HO

[21] Appl. No.: 09/161,072

[22] Filed: Sep. 25, 1998

[30] Foreign Application Priority Data

Oct. 3, 1997 [CA] Canada ..... 2217438

[51] Int. Cl.[7] ..... E03B 7/07

[52] U.S. Cl. ..... 137/563; 137/565; 417/430

[58] Field of Search ..... 137/563, 565, 137/59, 561 R; 417/430; 251/149, 147, 210

[56] References Cited

U.S. PATENT DOCUMENTS 4,457,326 7/1984 Donnelly .
4,481,966 11/1984 Anderson .
4,672,990 6/1987 Robillard .
4,790,289 12/1988 Barrett .
5,011,598 4/1991 Nathanson ..... 210/136
5,029,612 7/1991 Simbulan .
5,311,904 5/1994 Beppu .
5,314,619 5/1994 Runyon .
5,476,118 12/1995 Yokoyama .
5,622,207 4/1997 Frank .
5,699,859 12/1997 Poirier .

*Primary Examiner*—David J. Walczak
*Attorney, Agent, or Firm*—Mario D. Theriault

[57] ABSTRACT

An installation for connection to a water piping system comprising a water main and at least one branch pipe, for preventing a stagnation of water inside that branch pipe. A pumping unit is connected to first and second openings in the far end of the branch pipe for pumping water samples out of the branch pipe through the first opening, and back into the branch pipe through the second opening. The installation also comprises a conduit extending inside the branch pipe from the second opening to a proximity of the water main. The pumping unit is continually or intermittently operated for sampling a portion of the still or slow moving water at the far end of a branch pipe, and for pumping these water samples near the water main where the water flow inside the pipe is more active. Such circulation of water in a branch pipe prevents the stagnation of water at the far end of the branch pipe. In another aspect, there is provided a method for preventing stagnation of water in a water supply system. The method comprises the steps of extracting water samples from the far end of the branch pipe relative to the water main and pumping the water samples into the near end of the branch pipe through a branch valve and toward the water main.

20 Claims, 7 Drawing Sheets

METHOD AND APPARATUS FOR PREVENTING WATER FROM STAGNATING IN BRANCHES OF A MUNICIPAL WATER SUPPLY SYSTEM

FIELD OF THE INVENTION

This invention pertains to installations for recirculating water in water piping systems and more particularly, in branches and dead-ends of municipal water supply systems.

BACKGROUND OF THE INVENTION

Plumbing regulations and plumbing codes are very specific about preventing cross connections in a piping system and generally, licensed plumbers are apprehensive of these problems. A 'cross connection' is defined in plumbing code books as any actual or potential connection between a potable water system and any source of pollution or contamination.

It is generally accepted that stagnant water should always be considered contaminated and non-potable. Further, it is believed that stagnant water is not only found in marshes and ponds, but is also found in water piping systems and reservoirs that do not have sufficient flow to keep the water active, where water remains still for long period of time for example. Although the fact is often neglected, decaying water in a piping system is in direct contact with potable water and represents a cross-connection contamination that is believed to be harmful to the health of users supplied in water by that piping system.

Generally, municipal water Supply systems are flushed periodically to discharge stagnant water. It is often the case that the discharged water has a foul odour and filthy discolouration. Despite these periodic flushes, it is believed that the stagnation of water in municipal piping systems is a major cause of bad water taste, buildup of sediments in residential hot water reservoirs, and bacterial growth in toilet reservoirs and in drains of bathroom accessories. It is further believed that stagnant water in a piping system is a source of many persistent illnesses, digestive problems and the beginning of many diseases to those using and drinking water from those systems.

Another reason for periodically flushing water supply systems is to eliminate concentrations of chlorine or other disinfectant used in water supply systems which tend to accumulate at regions of low flow. In addition to being detrimental to a good health, high concentrations of chlorine in particular, are known to change the PH value of the water and to deteriorate the protective coating inside water pipes. The material of fabrication of the pipes, which may contain traces of toxic substances are then exposed to the potable water.

The problem of water stagnation is particularly noticeable near water hydrants for example and at the ends of long branches of a piping system where the number of users on a branch pipe is not sufficient for ensuring a proper circulation of water. These situations are often found in newer or partly built subdivisions, and at the end of streets which are supplied in water by oversized pipes. Furthermore, a number of municipalities have water supply systems that were designed according to fire prevention requirements. The size of many branch pipes in these systems is often too large to ensure an adequate circulation of water within the pipe under normal conditions.

The problem of stagnating water in municipal water supply systems has been generally overlooked in the past, and therefore, there are no known system or method for preventing such degradation of water quality.

SUMMARY OF THE INVENTION

In the present invention, however, there is provided an installation for connection to a water piping system comprising a water main and at least one branch pipe, for preventing a stagnation of water inside that branch pipe. In a first aspect of the present invention, the installation comprises a pumping unit connected to first and second openings in the far end of the branch pipe relative to the water main. The pumping unit has an inlet connection connected to the first opening and an outlet connection connected to the second opening for pumping water out of the branch pipe through the first opening, and back into the branch pipe through the second opening. The installation also comprises a conduit extending inside the branch pipe from the second opening to a proximity of the water main.

The pumping unit is continually or intermittently operable for sampling a portion of the still or slow moving water at the far end of a branch pipe, and for pumping these water samples near the water main where the water flow inside the pipe is more active. Such circulation of water in a branch pipe prevents the stagnation of water at the far end of the branch pipe. Further advantages of the installation of the present invention is that a connection thereof to a branch pipe of an existing system is doable without excavating the entire branch pipe. The setting of the pumping unit, the first and second openings and the conduit inside a branch pipe can be effected through a relatively small hole dug in the ground near the far end of the branch pipe. Therefore, the cost to a municipality for retrofitting an existing water supply system with several installations of the present invention is relatively small as compared to the cost of re-sizing the entire supply system to ensure an adequate active flow inside each branch pipe.

In accordance with another aspect of the present invention, the pumping unit comprises a tubular casing and a pump mounted inside the tubular casing. The tubular casing has a closed end and an openable end. The tubular casing has inlet and outlet connections extending through the wall thereof These inlet and outlet connections are releasable-type connections. The pump has inlet and outlet fittings respectively connected to the inlet and outlet connections. There is also provided a rod connected to one of the inlet and outlet fittings and extending to the openable end of the casing. This rod is usable for working the pump in and out of the releasable connections. When the tubular casing is buried into the ground with the openable end extending above the ground surface, the pump is removable from inside the casing for maintenance or for replacement for example, by a person standing above ground working the rod.

In accordance with another aspect of the present invention, the pumping unit comprises a submersible-type pump enclosed in a cartridge having an inlet opening connected to the inlet connection of the casing and an outlet opening connected to the outlet connection of the casing. The submersible-type pump is advantageous for its capacity to deliver relatively high pressure and flow rate where required to satisfy a large number of water system requirements.

In accordance with yet another aspect of the present invention, there is provided a method for preventing stagnation of water in a water supply system having a water main, a branch pipe connected to the water main and a branch valve connected between the branch pipe and the water main. The method comprises the steps of extracting water samples from the far end of the branch pipe relative to the water main and pumping the water samples into the near end of the branch pipe through the branch valve and toward the water main. When samples of water from the far end of a branch pipe are periodically or continually recirculated into the near end of the branch pipe relative to the water main, a freshening of water in that branch pipe is effected and water stagnation is prevented.

In accordance with yet a further aspect of the present invention, there is provided a pumping apparatus comprising a tubular casing having a closed end and an openable end. A pump is mounted inside the casing. There are also provided an inlet adapter extending through the casing and being connected to the inlet fitting of the pump, and an outlet adapter extending through the casing and being connected to the outlet fitting of the pump.

In such an apparatus, the casing and the pump are positional in the ground and the inlet and outlet adapters are connect-able to an underground piping system for pumping fluid through the piping system. This pumping unit is convenient for installation near the end of a branch pipe of a water supply system without having to built expensive vaults or other underground enclosures to house the pump. Other advantages of the pumping apparatus include the fact that it is manufacturable with commercially available pumps and releasable fittings and common water pipes. The pumping apparatus are manufacturable in few standard sizes and can be connected to a water supply system using lengthy flexible pipes. Therefore, the pumping apparatus of the present invention is self-contained, easily manufacturable, easily storable in standard sizes, and adaptable to a variety of situations and ground conditions.

BRIEF DESCRIPTION OF THE DRAWINGS

The preferred embodiments of the invention will be further understood from the following description, with reference to the drawings in which.

DETAILED DESCRIPTION OF THE PREFERRED EMBODIMENT

Figure 1:
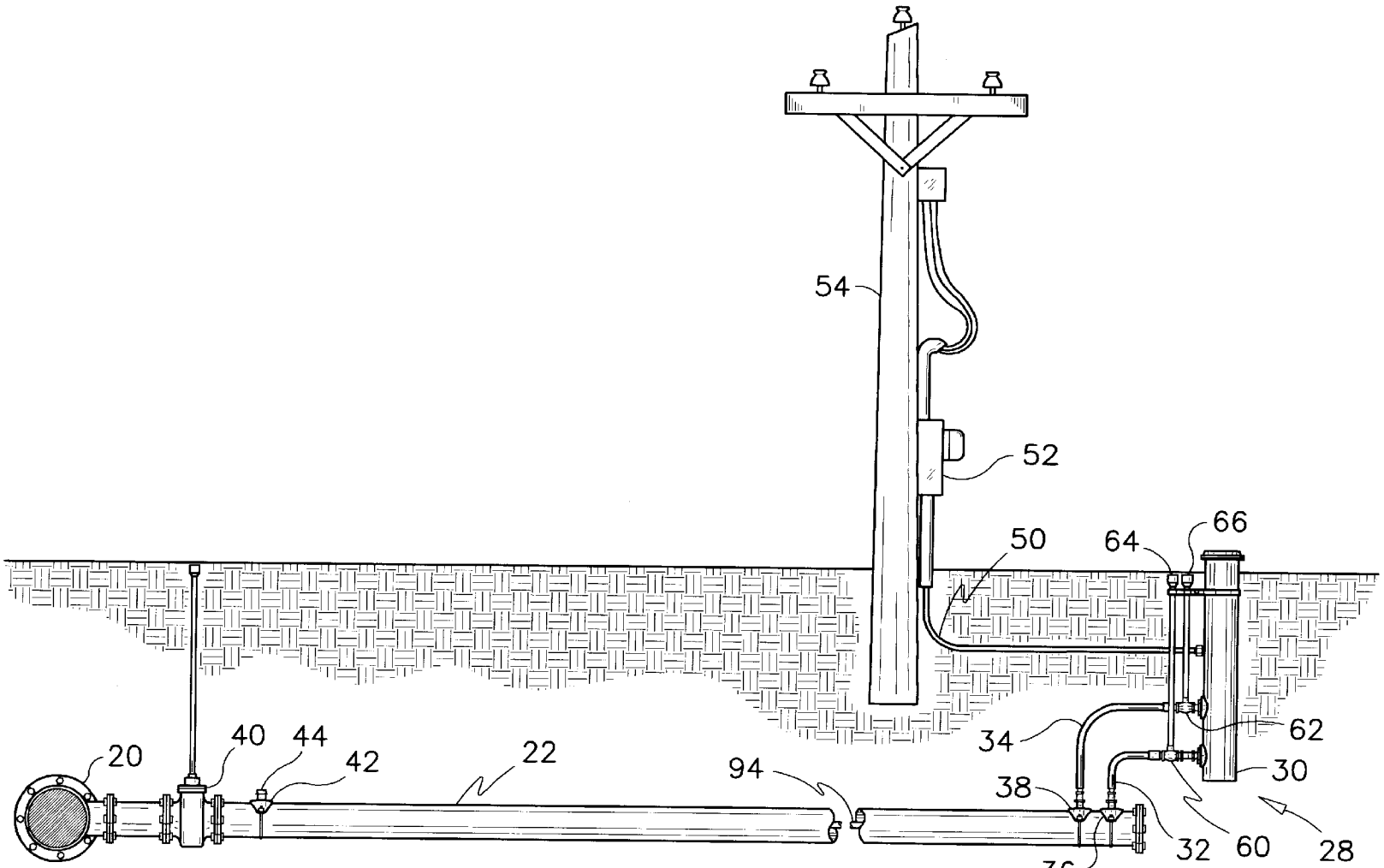
FIG. 1 is a cross-section view of a main water supply line, a side view of a branch pipe extending from the main line, and an elevation view of an apparatus of the first preferred embodiment connected to the end of the branch pipe.

Reference will firstly be made to FIG. 1 illustrating a typical installation of a pumping apparatus of a first preferred embodiment for recirculating water in a branch pipe. Before describing this installation in detail, however, it is deemed that certain general information should be reminded in order to afford a clearer understanding of the diagram of FIG. 1.

A municipal water supply system generally comprises a main pipe 20, or a water main in common terms, and several branch pipes 22 extending away from the main pipe 20. The branch pipes 22 typically supply water to residences on side streets for example. In many municipalities, however, newer streets have few houses therealong and the ends of those streets are generally last to be developed. A branch pipe 22 supplying water to few houses at the far end of a street is nonetheless a same diameter over the full length of the pipe. Therefore, the water inside the branch pipe 22 near the far end of the street remains still for long periods of time and tends to stagnate.

It is customary with municipal water supply systems to install fire hydrants (not shown) at regular intervals along a branch pipe and at the very end of the branch pipe. These fire hydrants are opened periodically for flushing stagnant water out of the ends of branch pipes. However, these periodic flushes are only a temporary remedy and not a cure. Therefore it is common with municipal water supply systems that the water drawn from a branch pipe 22 far from the water main 20 contains a high coliform count.

In the illustration of FIG. 1, the pumping apparatus of the first preferred embodiment 28 is installed near the end of a branch pipe 22 for pumping water from the end of the branch pipe, through a conduit 94 extending upstream inside the branch pipe 22 to a region in the branch pipe where the water flow is more active.

The pumping apparatus of the first preferred embodiment 28 comprises a vertical cylindrical casing 30 enclosing a pumping unit (not shown). The inlet 32 and outlet 34 pipes to and from the pumping unit are connected to the far end of the branch pipe 22 using a pair of saddle-type hole covers 36,38, sometimes referred to as "Clear Way"™ adapters.

The recirculation conduit 94 inside the branch pipe 20 preferably extends from the far end of the branch pipe to a region near a branch valve 40 used to isolate the branch pipe 22 for the water main 20. The recirculation conduit 94 inside the branch pipe 22 is preferably anchored to a third saddle-type adapter 42 and a first pipe stem 44 extending through the saddle-type adapter and inside the branch pipe 22.

Branch valves 40 are typically installed at short distances from a water main 20 between the water main 20 and a first take-off connection (not shown) to a first residence along that branch for example. Thus, the water circulation inside the branch pipe near the branch valve 40 is normally maximum for that branch pipe 22. When a branch pipe has several residences connected to it, the water near the inlet of the branch pipe is more active than at the far end of the branch pipe. Therefore a recirculation of water from the far end of a branch pipe to a region where the water is active prevents the water from stagnating near the far end of the branch pipe.

The apparatus of the first preferred embodiment 28 is preferably installed near the far end of a branch pipe 22 along a street right-of-way for example. Electrical power for the pumping unit inside the casing 30 of the apparatus is preferably supplied through an underground cable 50 from a power supply unit 52 mounted on a nearby hydro pole 54. The power supply unit 52 preferably has a power meter and an adjustable timer for intermittently operating the pump of the apparatus. It will be appreciated that the pumping unit and timer may also be operated from a remote location through communication lines or other signal transmitting devices.

The pumping apparatus of the first preferred embodiment 28 is preferably installed in the ground with the upper portion of the casing 30 extending above the ground. The pumping unit inside the casing 30 is thereby accessible for inspection or servicing for example.

A pair of shut-off valves 60,62 are also preferably provided on or near the apparatus of the preferred embodiment 28 for isolating the recirculating pump when required, from the pressure inside the branch pipe 22. Each shut-off valve preferably has a valve stem 64,66 extending near the surface of the ground, near a street curb for example, as it is customary with the valves of a municipal water supply system.

The installation of the apparatus of the first preferred embodiment is thereby effected without excavating the entire branch pipe 22. The installation of the pumping apparatus 28 at the far end of an existing branch pipe is relatively easily done without great expense to a municipality. The installation of the recirculation conduit 94 inside the branch pipe is done from the far end of the branch pipe using various methods known to plumbers and in particular by using a plumbing snake or a high pressure pipe cleaner with a self-propelled-type nozzle for example.

Figures 2, 3:
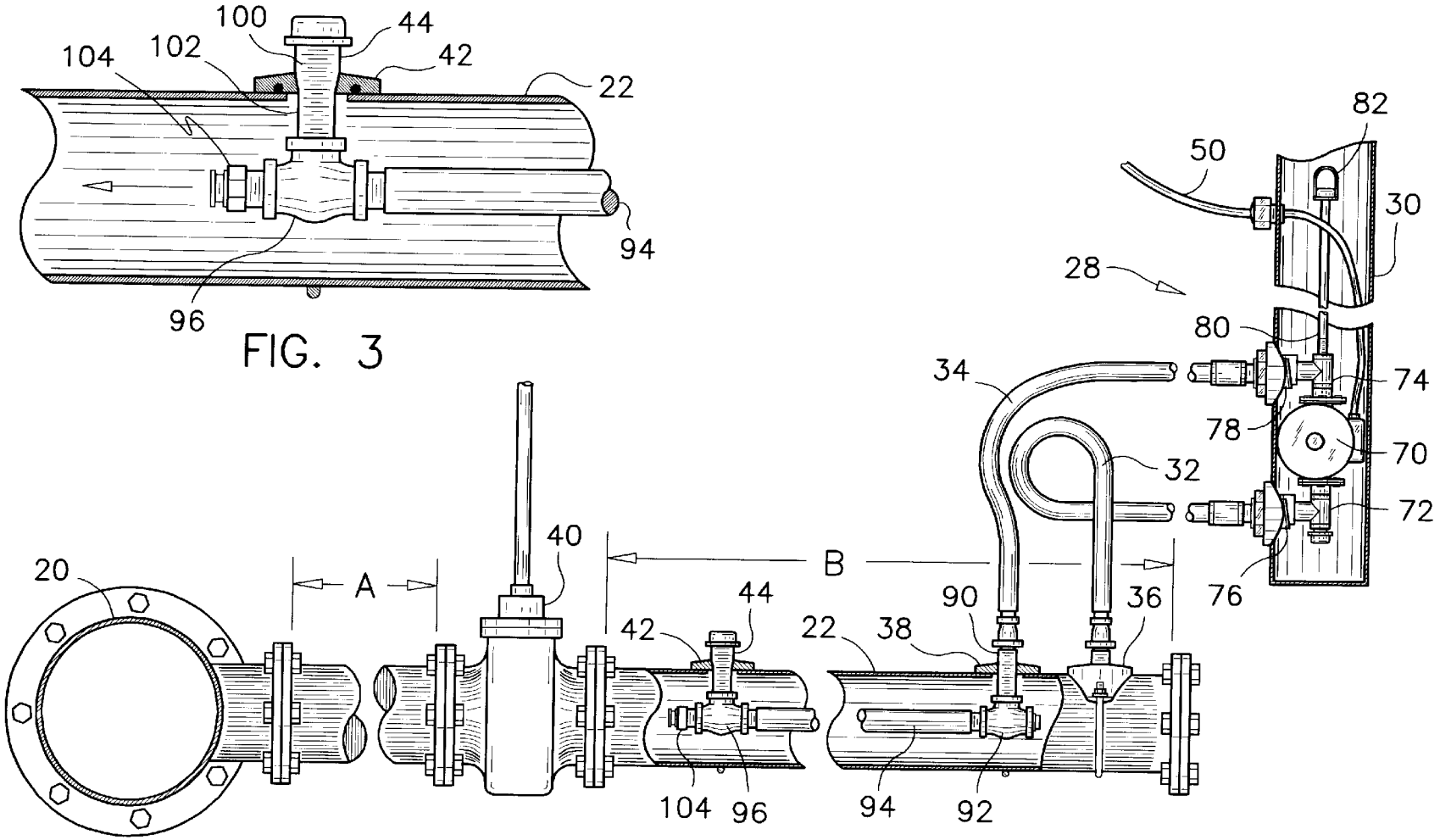
FIG. 2 is a partial cross-sectional view of a branch pipe and a cross-sectional view of a recirculating pumping unit of a first type usable inside the apparatus of the first preferred embodiment.
FIG. 3 is an enlarged cross-sectional view of a typical anchoring arrangement on a recirculation conduit.

Referring now to FIGS. 2 and 3, the pumping apparatus of the first preferred embodiment 28 and a preferred installation of the recirculation conduit 94 inside the branch pipe 22 are illustrated therein in greater details. The vertical cylindrical casing 30 of the apparatus of the first preferred embodiment 28 encloses a recirculation pump 70 of a first type having an inlet connection 72 and an outlet connection 74. Each connections 72,74 comprises a standpipe adapter coupling 76 or 78 often referred to as a "pitless adapter"™. This type of adapters has a wedge-type connection inside the casing 30 in which it is installed for receiving a fitting on equipment inside the casing, and a conduit extending through the wall of the casing.

The outlet connection 74 of the pump 70 preferably has a pipe or other rod-like member 80 extending upwardly and an eye hook 82 at the upper end of the rod-like member 80 for working the pump 70 into and out of the standpipe adapter couplings 76,78.

The inlet and outlet pipes 32,34 are preferably made of a flexible potable grade material and have a substantial length for accommodating situations where the branch pipe 22 is located under the pavement of a street and the casing 30 of the apparatus is installed along the outside edge of a sidewalk for example. The recirculating conduit 94 is also preferably made of a flexible potable grade material.

As mentioned earlier, the inlet pipe 32 is preferably connected to the far end of a branch pipe 22 by means of a first saddle-type adapter 36. The outlet pipe 34 is also connected through the branch pipe 22 by means of a second saddle-type adapter 38. The outlet pipe 34 is connected to a second pipe stem 90 extending through the second saddle adapter 38 and into a first T or elbow fitting 92.

The recirculation conduit 94 extends from the first T or elbow fitting 92 to a second T-fitting 96 near the branch valve 40. The fitting 96 is anchored to the branch pipe 22 by means of the first pipe stem 44 threaded through the third saddle-type adapter 42. The first pipe stem 44 preferably has a tapered pipe thread portion 100 for effecting a sealed connection into the third saddle-type adapter 42, and a straight thread portion 102 for connecting into the T-fitting 96. The T-fitting 96 being under water, the sealing of the threaded portion 102 into the T-fitting 96 is not critical and therefore a straight thread connection at this location is acceptable. The pipe stem 90 has a similar configuration for anchoring the fitting 92 to the second saddle-type adapter 38.

The preferred pipe size for the recirculation conduit 94, the inlet and outlet pipes 32,34 and the associated fittings are between about nominal 1.0 inch to about nominal 1½ inches, when the branch pipe size is about nominal 6–8 inches in diameter for example.

The T-fitting 96 further has a nozzle 104 connected thereto and oriented to eject water through the branch valve 40 and beyond the branch valve 40 towards the water main 20. Although the pressure through the nozzle 104 should preferably be sufficiently high to eject water into the water main 20, this feature is not essential for ensuring an adequate recirculation of water in a branch pipe 22 for preventing stagnation of water at the far end of that branch pipe 22. A distance 'A' between the branch valve 40 and the water main 20 is usually less that 10–15 feet. The length 'B', however, can be as long as a mile or more. Therefore, as it was mentioned before, the flow of water through the branch valve 40 when there is a substantial number of residences connected to that branch pipe 22 is sufficient to ensure a freshness of the water inside the branch pipe at that location. Hence, a mixing of the water from the far end of the branch pipe 22 with the water near the branch valve 40 is quite appropriate for preventing the stagnation of water near the far end of the branch pipe 22.

Figure 4:
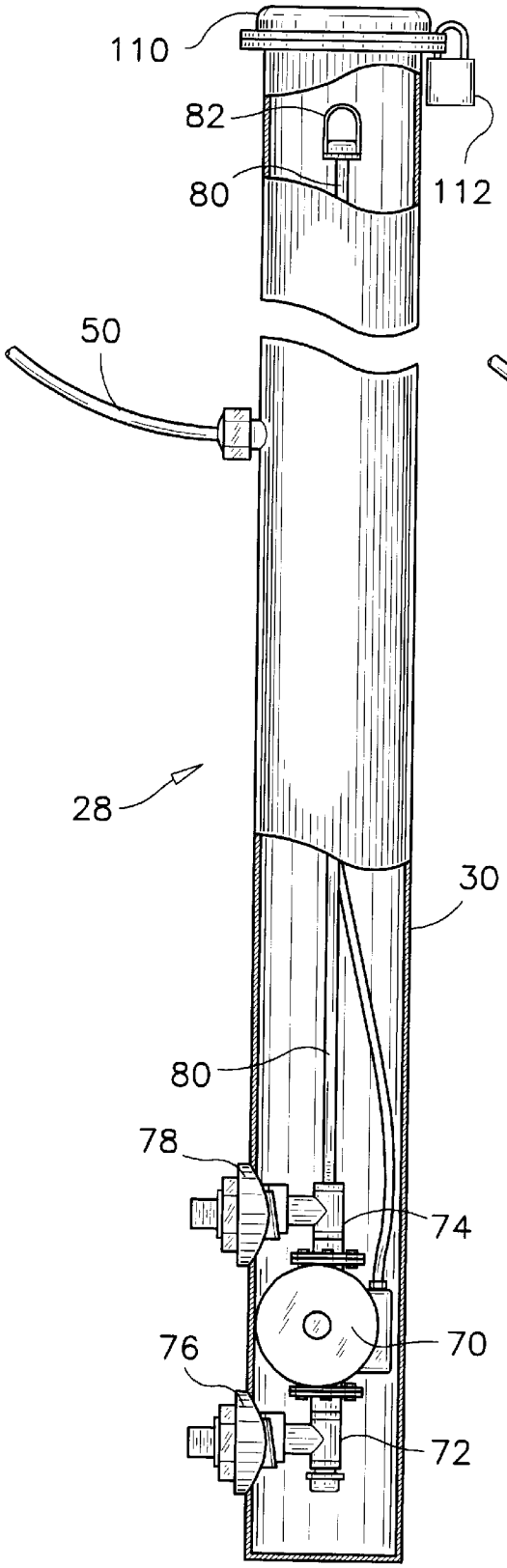
FIG. 4 is a partial cross-sectional view of the pumping apparatus of the first preferred embodiment showing a recirculating pumping unit of the first type usable inside the apparatus of the first preferred embodiment.
Figure 5:
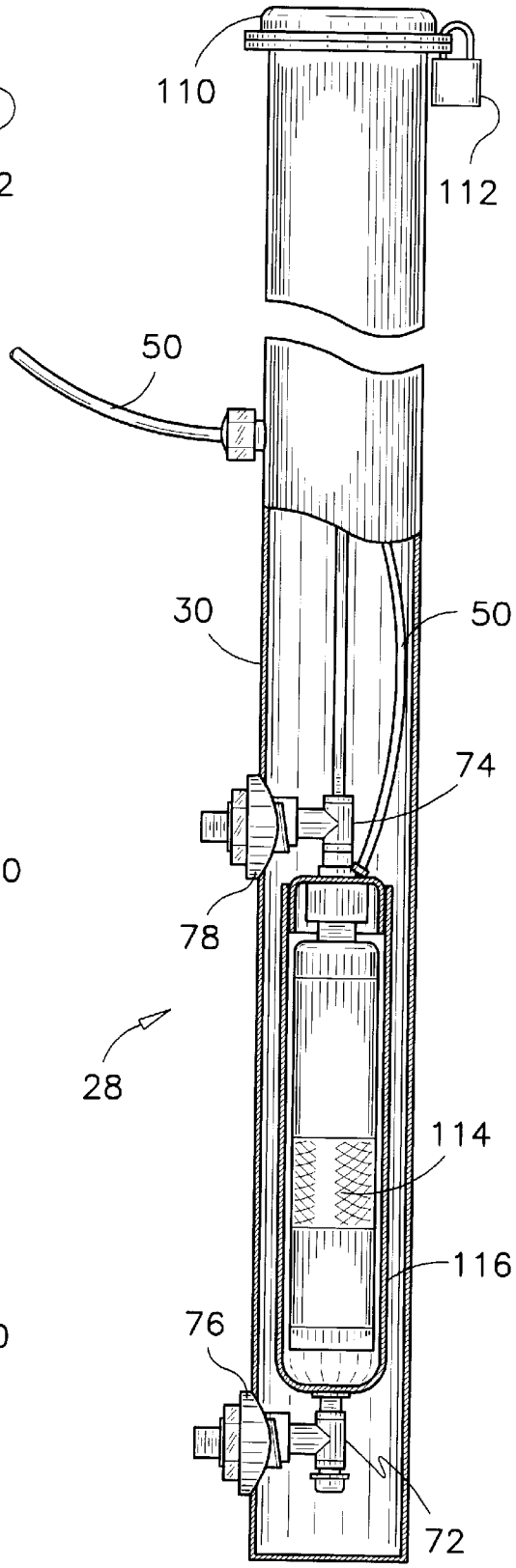
FIG. 5 is a partial cross-sectional view of the pumping apparatus of the first preferred embodiment showing a pumping unit of a second type usable inside the apparatus of the first preferred embodiment.

Referring now particularly to FIGS. 4 and 5, the pumping apparatus 28 of the first preferred embodiment is illustrated therein at a larger scale than in the previous drawings. The cylindrical casing 30 of the apparatus of the first preferred embodiment preferably has a cap 110 on the upper extremity thereof for allowing access inside the casing for servicing the pump 70 for example. The cap 110 is preferably a lockable-type cap having holes therein (not shown) for receiving a padlock 112.

As will be appreciated, the recirculating pump in the apparatus of the first preferred embodiment 28 may be a submersible type pump 114 as illustrated in FIG. 5 to satisfy a particular installation or a preference of the manufacturer of the apparatus. In this case, the submersible-type pump 114 is installed in a closed cartridge 116 having a bottom opening connected to the inlet connection 72 and a top opening connected to the outlet connection 74.

The length of the casing 30 is preferably sufficient to ensure that the pump 70 or 114, and the inlet and outlet connections 72,74 are located below the frost level when the apparatus of the first preferred embodiment 28 is installed in colder regions.

Figure 6:
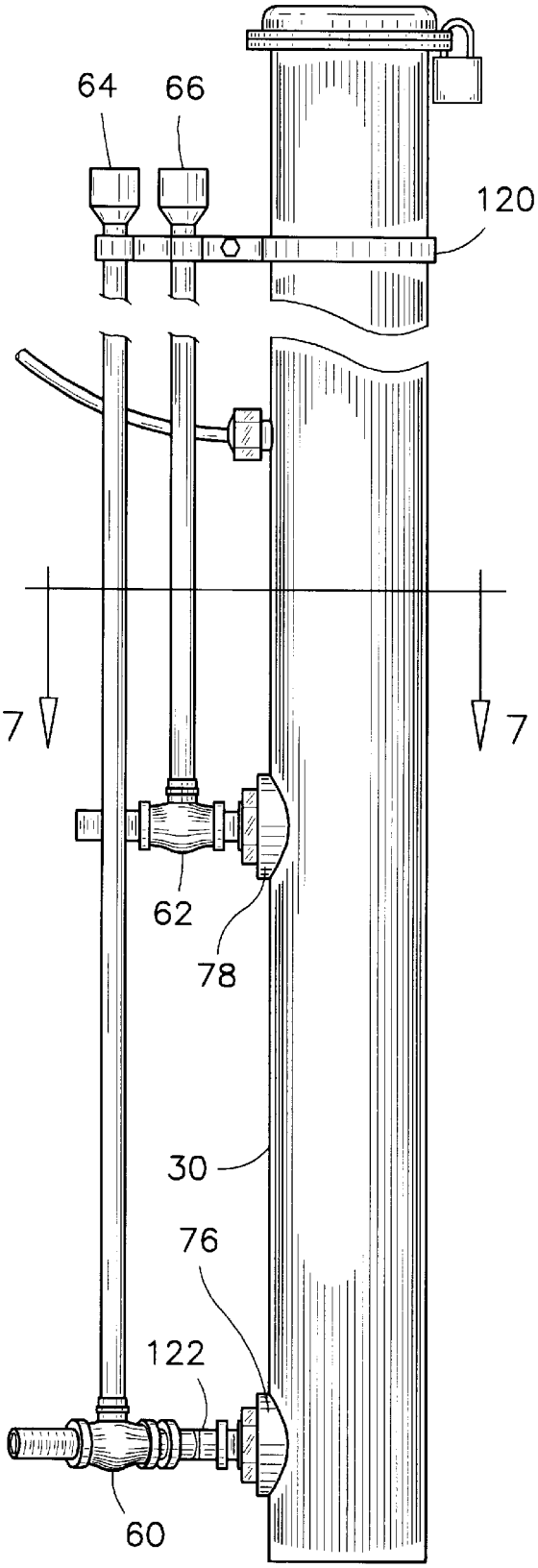
FIG. 6 is an elevation view of the pumping apparatus of the first preferred embodiment with shut-off valves mounted thereon.
Figure 7:
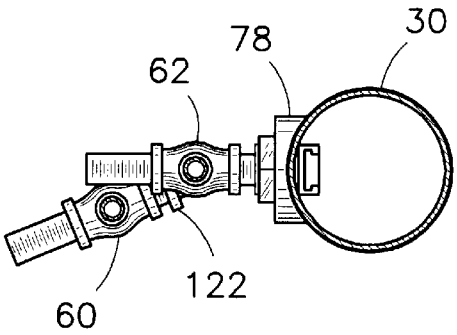
FIG. 7 is a transversal cross-sectional view through the casing of the pumping apparatus shown in FIG. 6, as seen along line 7—7 in FIG. 6, in which the illustration of a pump has been omitted for clarity.

Referring now to FIGS. 6 and 7, one variant of the pumping apparatus of the first preferred embodiment of the present invention has both shut-off valves 60,62 located adjacent the casing 30 of the apparatus. In this variant, a brace member 120 is provided for circling the cylindrical casing 30 and for clamping and guiding both valve stems 64,66 in a fixed alignment with the longitudinal axis of the casing 30. One of the shut-off valves, the inlet shut-off valve 60 in these illustrations, is preferably offset relative the outlet shut-off valve 62 when viewed from the upper end of the casing 30. For this purpose, a 22½° elbow 122 is preferably installed between the inlet shut-off valve 60 and the inlet standpipe adapter 76.

Figure 8:
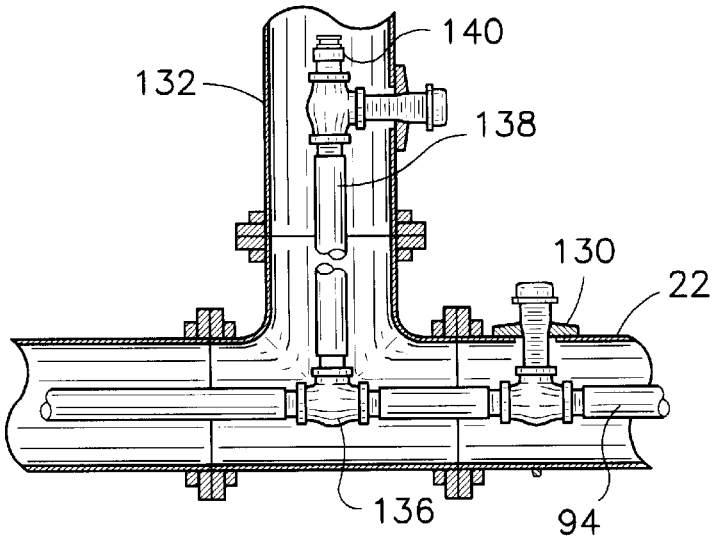
FIG. 8 is a cross-sectional plan view of a hydrant connection and a recirculating conduit extending therein.
Figure 9:
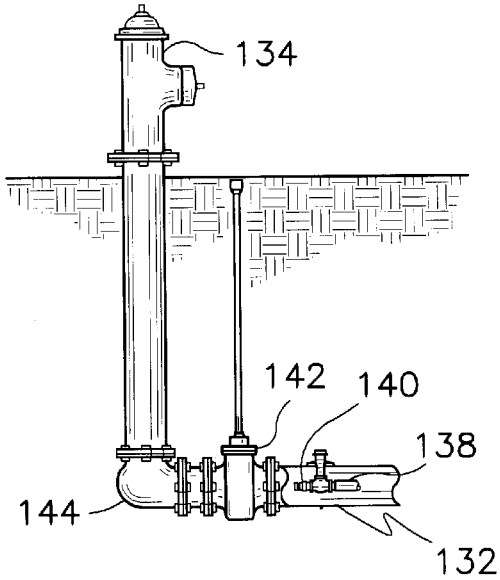
FIG. 9 is a side view of a typical hydrant installation and of a recirculation conduit extending near the hydrant's valve.

Another variant installation of the apparatus of the first preferred embodiment is illustrated in FIGS. 8 and 9. In these illustrations, a fourth saddle adapter 130 is installed adjacent a take-off connection 132 to a fire hydrant 134 for example, for anchoring the recirculation conduit 94 near the take-off connection 132. A further T-fitting 136 is spliced into the recirculation conduit 94 in line with the take-off pipe 132. A secondary conduit 138 having a nozzle 140 on its far end is connected to the T-fitting 136. Hence, when the pump 70 or 114 operates, the water from the far end of the branch pipe 22 is pumped through the recirculating conduit 94 and through the secondary conduit 138 for displacing the water inside the take-off pipe 132, for reaching through the hydrant's isolating valve 142 and for washing the hydrant's valve 144 and therefore, for also preventing a stagnation of water inside the take-off pipe 132. It will be appreciated that a capacity of the pumping unit 70 or 114 is determined according to the length and elevation of the branch pipe 22 and also to the number of fire hydrants 134 along that pipe 22.

Figure 10:
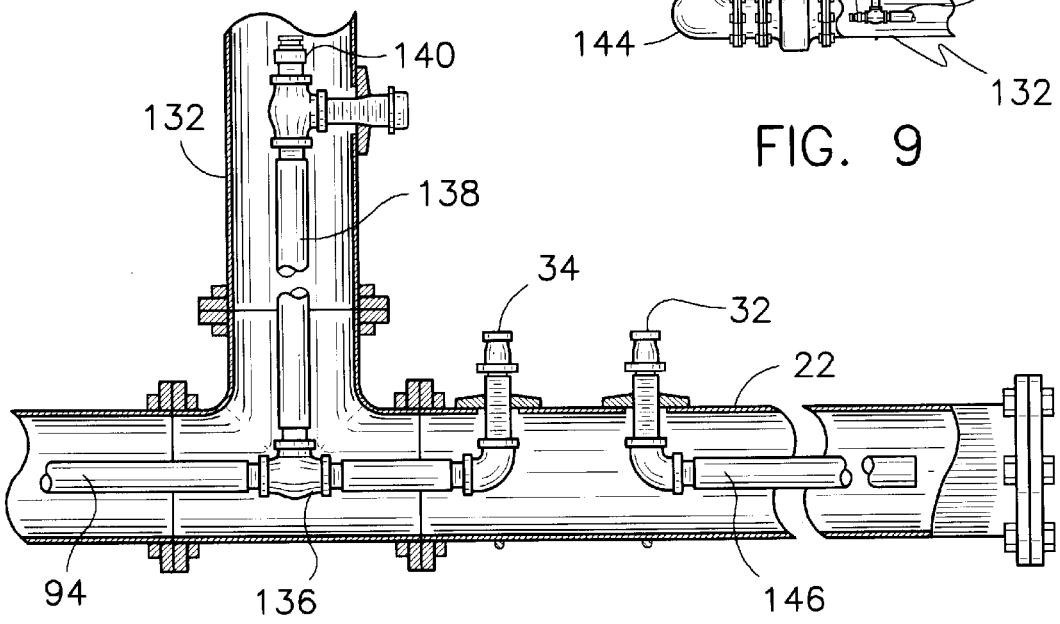
FIG. 10 is cross-sectional view of a branch pipe illustrating piping connections for an alternate installation of the apparatus of the first preferred embodiment near a hydrant take-off connection.

In the light of the present disclosure and of the illustration of the accompanying FIG. 10, the person skilled in the art will appreciate that the inlet and outlet pipes 32,34 for the installation of the pumping apparatus of the first preferred embodiment may also be located near a fire hydrant take-off pipe 132. Thus, when the far end of a branch pipe 22 is not easily accessible, a fire hydrant take-off connection 132 may be temporary removed for inserting the recirculation conduit 94 and a suction conduit 146 extending to the far end of the branch pipe 22.

Figure 11:
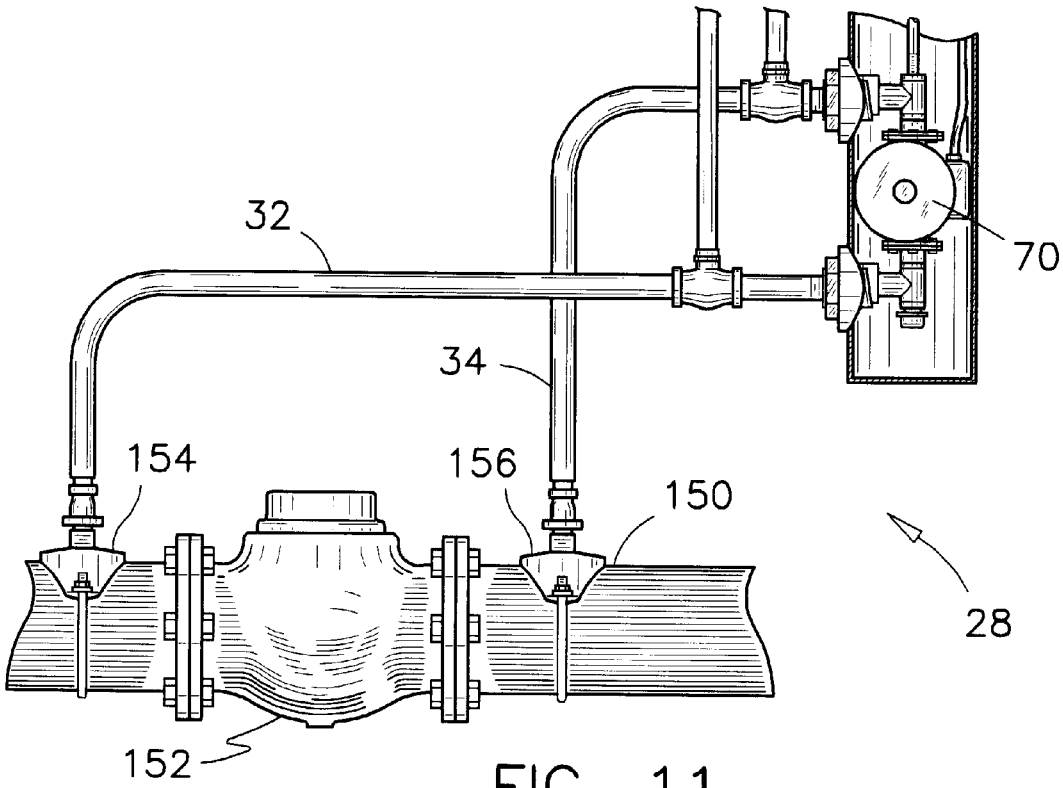
FIG. 11 is a side view of an installation of the pumping apparatus of the first preferred embodiment on a loop pipe in a water supply system, for recirculating water in that loop pipe.

Referring now particularly to FIG. 11, there is illustrated therein, a further variant installation of the pumping apparatus of the first preferred embodiment 28. In this installation, the apparatus 28 is connected to a loop pipe 150 having both ends (not shown) connected to the main line 20 of a water supply system. This type of piping system is common under streets having traffic circles or in large subdivisions having a plurality of quadrivial street arrangement. These loop pipes are also used for feeding water to large buildings such as schools, stores and factories. Stagnant water is also found in these loops, especially during vacation time when several occupants are gone for extended periods.

The pumping apparatus of the first preferred embodiment 28 is preferably installed in combination with a check valve 152 which is preferably installed near one end of the loop. In this typical installation, the inlet pipe 32 is connected to a saddle-type hole cover 154 on the loop pipe 150, on one side of the check valve 152. The outlet pipe 34 is connected to another saddle-type hole cover 156 on the loop pipe 150 on the other side of the check valve 152. The pump 70 is used for recirculating the water around the loop to prevent stagnation in that loop pipe 150.

Figure 12:
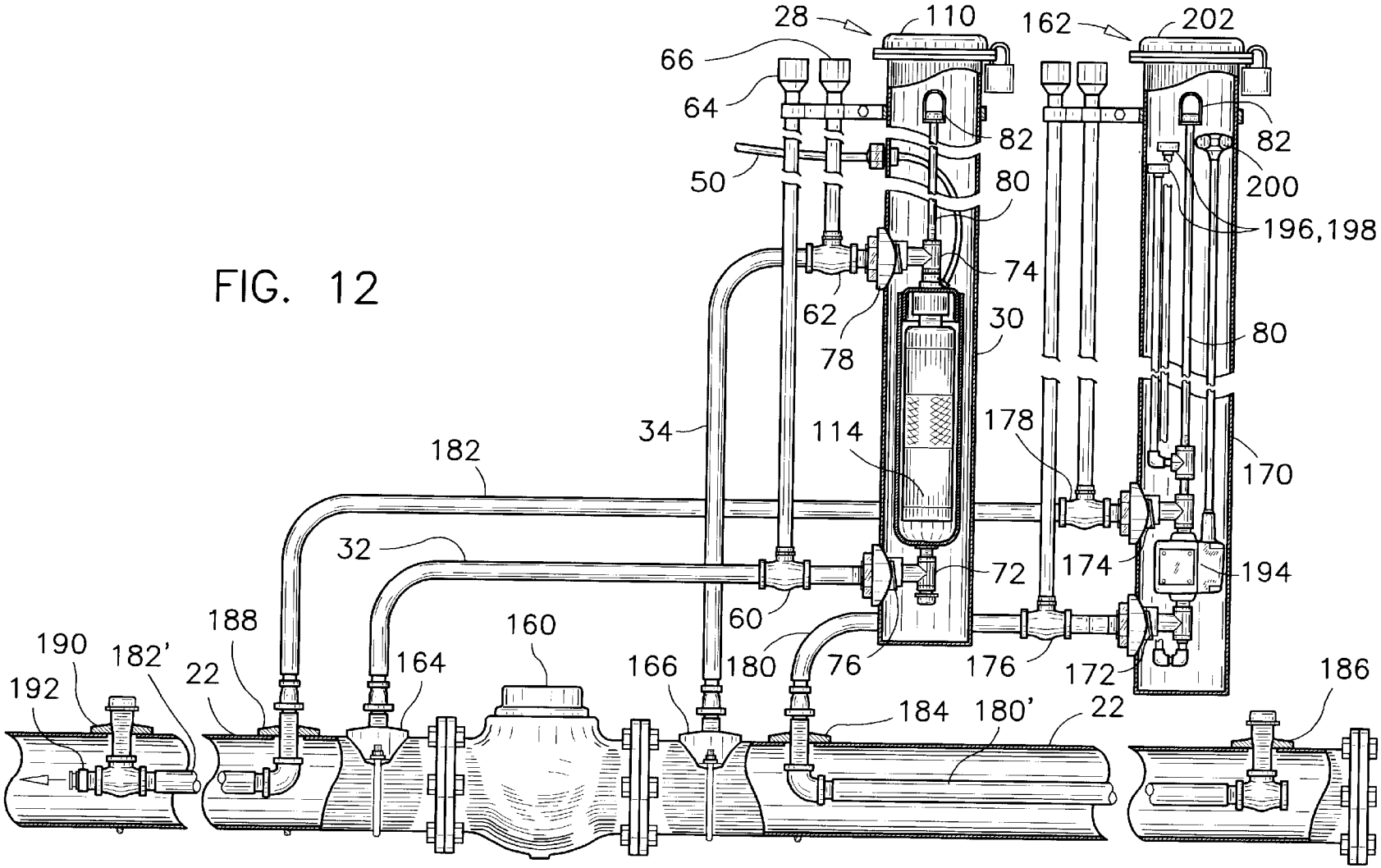
FIG. 12 is a cross-sectional view of a pumping apparatus of a first preferred embodiment wherein a pumping unit is usable as a booster pump for increasing the water pressure inside a branch pipe, and an apparatus of the second preferred embodiment containing a pressure regulating valve, for recirculating water in the branch pipe.

The illustration of FIG. 12 is referred to for describing yet another variant installation of the pumping apparatus of the first preferred embodiment 28. In this further installation, the pumping apparatus 28 is used for increasing the pressure in a branch pipe 22. In this installation, the apparatus 28 of the first preferred embodiment is also used in association with a check valve 160, and with an apparatus of the second preferred embodiment 162. The inlet pipe 32 of the pumping apparatus of the first preferred embodiment 28 is connected to a saddle-type hole cover 164 on the branch pipe 22, on the upstream side of a check valve 160. The outlet pipe 34 is connected to another saddle-type hole cover 166 on the branch pipe 22 on the downstream side of the check valve 160. The pump 114 is used for increasing the pressure in the downstream side of the check valve 160 relative to the upstream side. The check valve 160 may be installed anywhere along a branch pipe 22 where the pressure inside the pipe is known to fall below a preferred level.

The apparatus of the second preferred embodiment 162 comprises a casing 170 much like the casing 30 of the pumping apparatus 28 of the first preferred embodiment. There are also provided an inlet and outlet standpipe adapter couplings 172,174, and inlet valve 176, an outlet valve 178, and inlet pipe 180 and an outlet pipe 182. The inlet pipe 180 is connected to an inlet saddle-type hole cover 184 and extends inside the branch pipe to the far end of the branch pipe 22. The inlet pipe 180' is preferably anchored to the far end of the branch pipe, at 186, when the hole cover 184 is at a substantial distance from the far end of the branch pipe.

The outlet pipe 182 is connected to a saddle-type hole cover 188, and extends inside the branch pipe 22 to an anchor point 190 near the branch valve 40 (not shown), such as in the installation illustrated in FIGS. 1 and 2. The outlet pipe 182' has a nozzle 192 as in the previously-described installations.

When the booster pump 114 operates, the pressure at the far end of the branch pipe 22 is raised above the pressure in the upstream side of the check valve 160. Thus, the water from the far end of the branch line 22 is forced through the inlet pipe 180', through the apparatus of the second preferred embodiment 162 and out through the outlet pipe 182' and nozzle 192 to recirculate water from the far end of the branch pipe 22 to a region near the main line 20. In order to maintain a higher pressure on the downstream side of the check valve 160, there is provided a pressure regulating valve 194 mounted inside the casing 170 of the apparatus of the second preferred embodiment 162 . This pressure regulating valve 194 is connected in-line between the inlet adapter coupling 172 and the outlet adapter coupling 174. A pair of pressure gauges 196,198 are also provided near the upper end of the casing 170 for monitoring the pressure at the inlet and outlet adapter couplings 172,174 respectively. The adjustment knob 200 of the pressure regulating valve 194 is also preferably located near the upper end of the casing 170 such that an adjustment of the valve 194 may be effected from the surface of the ground through the access cover 202 of the apparatus of the second preferred embodiment 162.

Accordingly, the combination of the apparatus of the first and second preferred embodiments 28,162 is usable for simultaneously increasing the pressure in a branch pipe 22 of a water supply system, and for recirculating the water in that branch pipe for preventing a stagnation of water at the far end of that branch pipe.

While the above description provides a full and complete disclosure of the preferred embodiments of this invention, various modifications, alternate constructions, alternate uses and equivalents may be employed without departing from the true spirit and scope of the invention. Such changes might involve alternate components, structural arrangements, construction features or the like. Therefore, the above description and the illustrations should not be construed as limiting the scope of the invention which is defined by the appended claims.

I claim:

1. An installation for connection to a water piping system comprising a water main and at least one branch pipe, for preventing a stagnation of water inside said branch pipe; said branch pipe having a near end connected to said water main and a far end at a distance from said near end; said installation comprising:

a pumping unit comprising a pump enclosed in a tubular casing buried in the ground near said far end of said branch pipe, said pumping unit being connected to said branch pipe and having means for extracting water sample from said far end and means for ejecting said water sample into said near end;

such that when said pumping unit operates, water samples from said far end are pumpable toward said water main for preventing stagnation of water in said far end of said branch pipe.

2. The installation as claimed in claim 1, wherein said branch pipe has a first and second openings, said pumping unit has inlet and outlet fittings and said means for extracting water sample comprises an inlet connection and an outlet connection, said inlet connection being connected to said first opening and to said inlet fitting, and said outlet connection being connected to said outlet fitting and to said second opening, for pumping said water sample out of said branch pipe through said first opening and back into said branch pipe through said second opening, and said means for ejecting said water sample into said near end comprises a conduit extending inside said branch pipe from said far end of said branch pipe to a proximity of said near end of said branch pipe, said conduit having a first end connected to said second opening for receiving said water sample pumped through said second opening, and a second end pointed toward said water main for ejecting said water sample toward said water main.

3. The installation as claimed in claim 2, wherein said first and second openings are in said far end of said branch pipe.

4. The installation as claimed in claim 2, wherein said pump is a submersible-type pump.

5. The installation as claimed in claim 4 wherein said pump is enclosed in a cartridge having an inlet opening connected to said inlet connection and an outlet opening connected to said outlet connection.

6. The installation as claimed in claim 5, wherein said pumping unit comprises a rod means connected to one of said inlet and outlet connections and extending to an end of said tubular casing, for working said pump in and out of said tubular casing.

7. The installation as claimed claim 1, wherein said pumping unit comprises inlet and outlet connections extending through a wall of said tubular casing.

8. The installation as claimed in claim 7, wherein said inlet and outlet connections are of a wedge-type releasable connections.

9. The installation as claimed in claim 7, further comprising first and second shut-off valves respectively connected to said inlet and outlet connections outside said tubular casing.

10. The installation as claimed in claim 1, wherein said pumping unit has inlet and outlet connections and further comprises a submersible-type pump enclosed in a cartridge having an inlet opening connected to said inlet connection and an outlet opening connected to said outlet connection.

11. A method for preventing stagnation of water in a water supply system having a water main, a branch pipe connected to said water main and a branch valve connected between said branch pipe and said water main, said branch pipe having a far end and a near end relative to said water main, said method comprising the steps of: extracting water sample from said far end, and pumping and conveying said water sample inside said branch pipe and into said near end for causing a recirculation of water in said branch pipe.

12. The method as claimed in claim 11, further comprising the step of ejecting said water sample through said branch valve toward said water main.

13. The method as claimed in claim 11, wherein said step of pumping said water sample comprises the step of increasing a water pressure in said far end relative to said near end.

14. The method as claimed in claim 13, further including the step of checking a water flow in said branch pipe.

15. The method as claimed in claim 14, further including the step of regulating a water pressure in said branch pipe.

16. A pumping apparatus comprising:

a tubular casing having a closed end and an openable end;

a pump mounted inside said casing, said pump having an inlet fitting and an outlet fitting;

an inlet adapter having pipe connection means and extending through said casing and being connected to said inlet fitting;

an outlet adapter having pipe connection means and extending through said casing and being connected to said outlet fitting;

such that said casing and said pump are positional in the ground and said inlet and outlet adapters are connectable to an underground piping system for pumping fluid through said piping system.

17. The pumping apparatus as claimed in claim 16, wherein each said inlet and outlet adapters comprises a wedge-type releasable connection.

18. The pumping apparatus as claimed in claim 16, further comprising a rod means extending from one of said inlet and outlet fittings to said openable end of said casing.

19. The pumping apparatus as claimed in claim 16, further having first and second shut-off valves respectively connected to said inlet and outlet adapters outside said casing, and first and second valve stems respectively extending from said first and second shut-off valves to said openable end of said casing.

20. The pumping apparatus as claimed in claim 16, wherein said pump is a submersible-type pump enclosed in a cartridge having an inlet opening connected to said inlet adapter and an outlet opening connected to said outlet adapter.

* * * * *